US010714045B2

(12) United States Patent
Sun et al.

(10) Patent No.: US 10,714,045 B2
(45) Date of Patent: Jul. 14, 2020

(54) CONTROL DEVICE AND CONTROL METHOD FOR DISPLAY MODULE, AND DISPLAY DEVICE

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Jigang Sun, Beijing (CN); Pengjun Chen, Beijing (CN); Hao Zhang, Beijing (CN)

(73) Assignees: BOE TECHNOLOGY GROUP CO., LTD., Beijing (CN); ORDOS YUANSHENG OPTOELECTRONICS CO., LTD., Ordos (CN)

( * ) Notice: Subject to any disclaimer, the term of this patent is extended or adjusted under 35 U.S.C. 154(b) by 626 days.

(21) Appl. No.: 15/292,361

(22) Filed: Oct. 13, 2016

(65) Prior Publication Data

US 2017/0206851 A1 Jul. 20, 2017

(30) Foreign Application Priority Data

Jan. 15, 2016 (CN) ..... 2016 1 0028792

(51) Int. Cl.
*G09G 3/36* (2006.01)

(52) U.S. Cl.
CPC ... *G09G 3/3696* (2013.01); *G09G 2300/0809* (2013.01); *G09G 2310/0237* (2013.01);
(Continued)

(58) Field of Classification Search
CPC ..... G09G 3/3696; G09G 2330/026; G09G 2330/027; G09G 2320/0247; G09G 2310/0237; G09G 2300/0809
See application file for complete search history.

(56) References Cited

U.S. PATENT DOCUMENTS

2008/0122812 A1* 5/2008 Park ..... G09G 3/3648 345/204
2011/0175883 A1* 7/2011 Toyotaka ..... G09G 3/3648 345/211

(Continued)

FOREIGN PATENT DOCUMENTS

CN 1588529 A 3/2005
CN 102290032 A 12/2011

(Continued)

OTHER PUBLICATIONS

The First Chinese Office Action dated Jun. 28, 2017; Appln. No. 201610028792.2.

*Primary Examiner* — Kent W Chang
*Assistant Examiner* — Andrew Lee

(57) ABSTRACT

A control device is disclosed, the control device configured to control a display module and comprising a judgment module and a storage module, wherein the judgment module is configured to receive a reference voltage and to receive a supply voltage of the display module, and is configured to judge whether the display module is supplied with power or not according to the reference voltage and the supply voltage; and the storage module is connected with the judgment module and is connected with a display screen of the display module, the storage module is configured to store a preset image, and where the display module is supplied with power, the storage module transmits the preset image to the display screen so that the display screen displays the preset image. A control method and a display device are also disclosed.

10 Claims, 2 Drawing Sheets

(52) U.S. Cl.
CPC ..... *G09G 2320/0247* (2013.01); *G09G 2330/026* (2013.01); *G09G 2330/027* (2013.01)

(56) References Cited

U.S. PATENT DOCUMENTS

| | | | | |
|---|---|---|---|---|
| 2011/0310135 | A1* | 12/2011 | Feng | G09G 3/3648 345/690 |
| 2016/0125782 | A1* | 5/2016 | Park | G09G 3/2003 345/691 |
| 2016/0358591 | A1* | 12/2016 | Chou | G09G 5/393 |

FOREIGN PATENT DOCUMENTS

| | | | |
|---|---|---|---|
| CN | 102779019 | A | 11/2012 |
| CN | 103458289 | A | 12/2013 |
| CN | 104269148 | A | 1/2015 |
| JP | 2014-048647 | A | 3/2014 |

* cited by examiner

CONTROL DEVICE AND CONTROL METHOD FOR DISPLAY MODULE, AND DISPLAY DEVICE

TECHNICAL FIELD

Embodiments of the present disclosure relate to a control device and a control method for a display module, and a display device.

BACKGROUND

Typically, a display device comprises a display module, which comprises a display screen and a backlight source laminated together, and an external control chip connected with the display module. When the display device is turned on, after the power is supplied, the display screen needs to be initialized and the backlight source needs to be lightened up. To shorten the boot time, both initialization and lightening backlight source are usually performed at the same time, which often causes a flickering or blurred display screen when the display device is turned on. When turning on, if the initialization is performed firstly, and then the backlight source is lightened up, a flickering or blurred display screen will be eliminated, however, the boot time is inevitably prolonged.

SUMMARY

At least one embodiments of the disclosure provides control device, configured to control a display module and comprising a judgment module and a storage module, wherein the judgment module is configured to receive a reference voltage and to receive a supply voltage of the display module, and is configured to judge whether the display module is supplied with power or not according to the reference voltage and the supply voltage; and the storage module is connected with the judgment module and is connected with a display screen of the display module, the storage module is configured to store a preset image, and where the display module is supplied with power, the storage module transmits the preset image to the display screen so that the display screen displays the preset image.

At least one embodiment of the present disclosure provides a method of controlling a display module which comprises a display screen and a backlight source, the method comprising: supplying power to the display module; transmitting a preset image to the display screen, while initializing the display screen and lighting on the backlight source of the display module.

At least one embodiment of the present disclosure provides a display device comprising a display module, wherein the display device further comprises the control device of the display module, and the control device is connected with the display module.

The control device, the control method and the display device according present disclosure can avoid flickering screen and blurred screen when turning on the display device, without prolonging the booting time.

BRIEF DESCRIPTION OF THE DRAWINGS

In order to clearly illustrate the technical solutions of the embodiments of the disclosure, the drawings of the embodiments will be briefly described in the following; it is obvious that the drawings described below are only related to some embodiments of the disclosure and thus are not limitative of the disclosure.

EXPLANATION OF REFERENCE SIGNS

Figure 1:
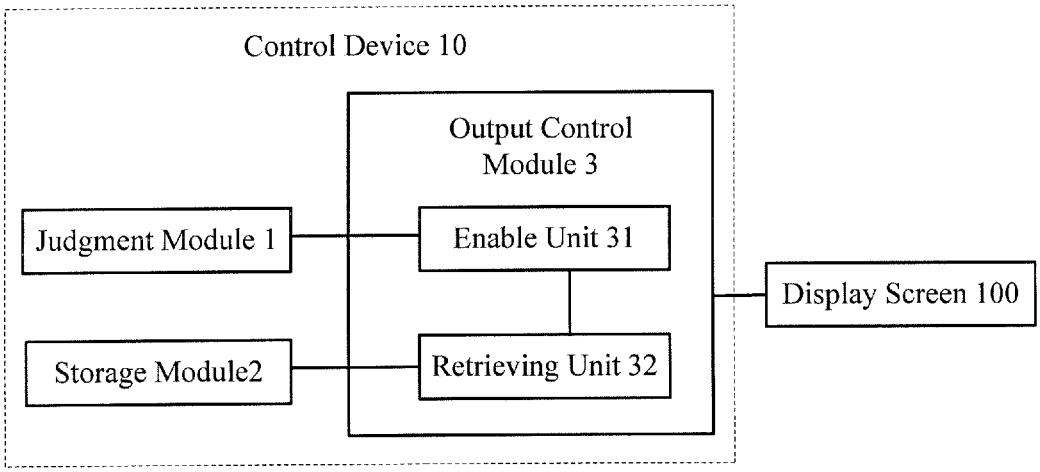
FIG. 1 is an illustrative structural view of a control device according to Embodiment One of the present disclosure.

1—judgment module
2—storage module
3—output control module
31—enable unit
32—retrieving unit
100—display screen
A—comparator
R1—first resistor
R2—second resistor
R3—third resistor
R4—fourth resistor
T1—first switching transistor
T2—second switching transistor
Vin—power supply voltage
Vref—reference voltage
Vdd—power source voltage
V1—control signal
V2—enable signal

DETAILED DESCRIPTION

In order to make objects, technical details and advantages of the embodiments of the disclosure apparent, the technical solutions of the embodiment will be described in a clearly and fully understandable way in connection with the drawings related to the embodiments of the disclosure. It is obvious that the described embodiments are just a part but not all of the embodiments of the disclosure. Based on the described embodiments herein, those skilled in the art can obtain other embodiment(s), without any inventive work, which should be within the scope of the disclosure.

Embodiment One

A display device comprises a display module, which comprises a display screen and a backlight source laminated together, and an external control chip connected with the display module. According to whether there is a random access memory in the external control chip, a control chip can be classified into a control chip without a random access memory and a control chip with a random access memory. For the control chip without a random access memory, its operation mode is a video mode. The term "video mode" means that the control chip directly transmits image information to the display screen in real time. Such an operation mode can meet higher requirements for the internal timing of the display screen. For the control chip with a random access memory, its operation mode comprises a video mode and a command mode. The term "command mode" means that image information transmitted by the control chip is stored in the random access memory provided in the control chip and when the same image information is needed once again, it is not necessary for the control chip to retransmit the image information, while the image information is just retrieved from the random access memory. Such an operation mode can decrease refreshing times of the control chip and reduce power consumption.

As discussed in the background part, if initialization of the display screen and lightening up the backlight source are performed at the same time when the display device is turned on, the display screen may flicker or may be blurred.

The inventors of the present disclosure have found that one reason for this problem is as follow.

If initialization of the display screen and lighting on the backlight source are performed concurrently at the time of booting, since it takes a certain period of time for the initialization, the initialization has not been finished when the backlight source is lighted on, and thus the display screen will not receive the image information. If the control chip is in the video mode, the display screen cannot display images when the backlight source is lighted on, thereby causing the display screen to flicker. If the control chip is in the command mode, the display screen will retrieve random image information from the random access memory and display the random image information when the backlight source is lit on, thereby causing the display screen to be blurred.

When the display device is turned on and powered on, if the initialization is performed firstly and the image information is transmitted to the display screen, and the backlight source is then lit on after the initialing operation is finished or is about to be finished, the flickering screen or the blurred screen can be eliminated, but the booting time will be prolonged.

Figure 2:
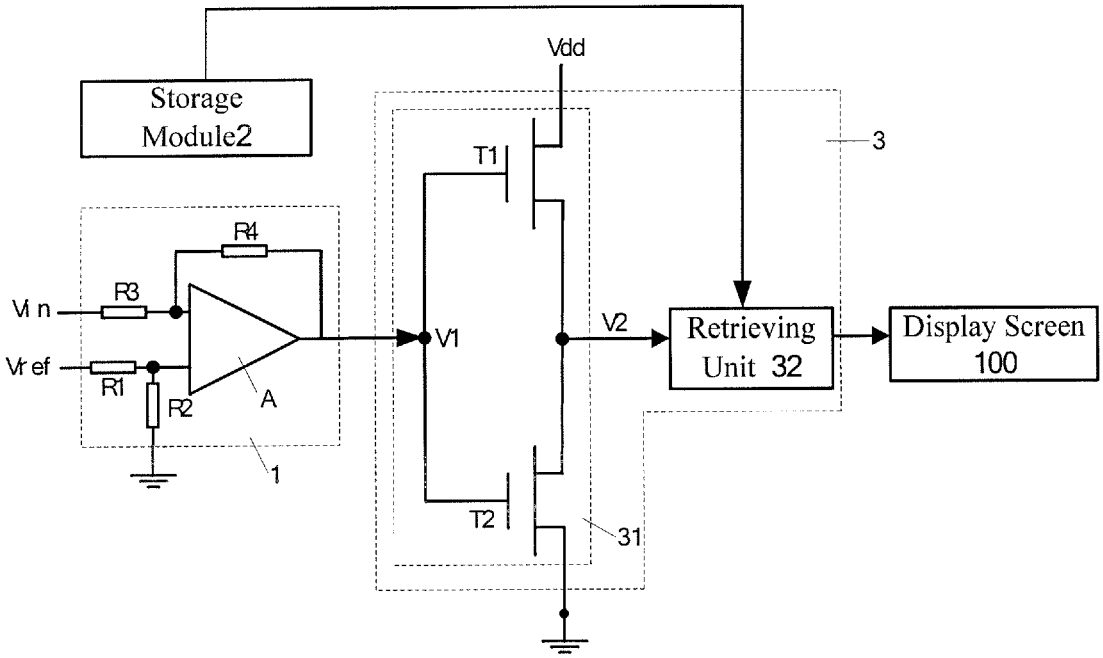
FIG. 2 is a schematic circuit diagram of the control device according to Embodiment One of the present disclosure.

Therefore, at least one embodiment of the present disclosure provides a control device which is configured to control the display module. The display module comprises a display screen and is connected with a control chip having thereon a supply voltage signal terminal via which an external power supply applies a supply voltage to the control chip and the display module. As illustrated in FIG. 1 and FIG. 2, the control device 10 according to the present embodiment comprises a judgment module 1 and a storage module 2. The judgment module 1 receives a reference voltage Vref. The judgment module 1 is connected with the control chip and receives the supply voltage Vin of the display module. The storage module 2 is connected with the judgment module 1. It is to be noted that the term of "connect" here indicates that the storage module 2 and the judgment module 1 can be directly connected or the storage module 2 can be connected with the judgment module 1 via some components. The storage module 2 is configured to store a preset image and is connected with the display screen 100 of the display module.

In the above-described control device, the judgment module 1 is configured to judge whether the display module is supplied with power or not according to the reference voltage Vref and the supply voltage Vin. The reference voltage Vref is a reference to judge whether the display module is supplied with power or not. The supply voltage Vin is a voltage applied to the display module. The supply voltage Vin being higher than or equal to the reference voltage Vref indicates that the display module is supplied with power. The supply voltage Vin is lower than the reference voltage Vref indicates that the display module is not supplied with power. When the display module is supplied with power, the storage module 2 transmits the stored preset image to the display screen 100 so that the display screen 100 displays the preset image.

When the control device according to the present embodiment is used to control the display module, the reference voltage Vref is transmitted to the judgment module 1 of the control device via a reference voltage signal terminal, and at the same time, the judgment module 1 receives the supply voltage Vin and the judgment module 1 compares the supply voltage Vin with the reference voltage Vref. When the supply voltage Vin is higher than or equal to the reference voltage Vref, it is determined that the display module is supplied with power. Such judgment result is sent to the storage module 2. Upon receiving the judgment result, the storage module 2 sends the preset image stored therein to the display screen 100 of the display module, so that the display module displays the preset image on the display screen 100 immediately after being supplied with power.

On the basis of the above, even if initialization and lighting on the backlight source of the display module are performed concurrently after the display module is supplied with power, when the backlight source is lighted on and the initialization has not been finished yet, if the control chip is in the video mode and the image information transmitted during initialization has not been transmitted to the display screen 100, since the display screen 100 is displaying the preset image, the preset image will cover up the phenomenon of splash screen caused by lighting on the backlight source, and if the control chip is in the command mode, the random access memory provided in the control chip sends the random image information to the display screen 100, as the display screen is displaying the preset image at this time, the random image will not be displayed on the display screen 100, so that the phenomenon of blurred screen is prevented. Therefore, by using the control device according to the present embodiment to control the display module when the display module is supplied with power, after power-on, the initialization and lighting the backlight source on can be performed concurrently, so that the booting time will not be prolonged and flickering screen and blurred screen caused by operations of initialization and lighting the backlight source on being performed at the same time will not occur.

Of course, the above control device can be also configured to only receive the supply voltage Vin, while the reference voltage Vref is a built-in preset voltage. The supply voltage Vin being higher than or equal to the reference voltage Vref indicates that the display module is supplied with power and the supply voltage Vin being lower than the reference voltage Vref indicates that the display module is not supplied with power.

As illustrated in FIG. 2, in the control device according to the present embodiment, the judgment module 1 can comprise a comparator A. The comparator A comprises a first input terminal which is configured to receive the reference voltage Vref, a second input terminal which is configured to receive the supply voltage Vin and an output terminal which is connected with the storage module 2 and is configured to output the comparing result of the comparator A. It is to be noted that the term of "connect" here indicates that the storage module 2 and the judgment module 1 can be directly connected or the storage module 2 can be connected with the judgment module 1 via some components. The comparator A can compare the reference voltage Vref with the supply voltage Vin and output the comparing result.

In one embodiment of the present disclosure, the reference voltage Vref can be in a range of 0 to 2V.

In the above solution of the comparator A, a first resistor R1, a second resistor R2, a third resistor R3 and a fourth resistor R4 can be additionally provided in the judgment module 1. The first resistor R1 has one end configured to receive the reference voltage Vref and the other end connected with the first input terminal of the comparator A. The second resistor R2 has one end connected with the first input terminal of the comparator A and the other end grounded. The third resistor R3 has one end configured to receive the supply voltage Vin and the other end connected with the second input terminal of the comparator A. The fourth resistor R4 has one end connected with the second input terminal of the comparator A and the other end connected with the output terminal of the comparator. The first resistor R1, the second resistor R2 and the third resistor R3 is for distributing voltage, thereby ensuring a safe and stable operation of the comparator A. The fourth resistor R4 is configured to feed back a voltage of the output terminal of the comparator A to the second input terminal the comparator A.

Referring to FIG. 1 and FIG. 2, to transmit the preset image in the storage module 2 to the display screen 100 when the display module is supplied with power, an output control module 3 can be additionally provided in the control device according to the present embodiment. The output control module 3 is connected with the judgment module 1. And the output control module 3 is connected with the storage module 2 and is connected with the display screen 100. After the judgment module 1 outputs a judging result, the output control module 3 receives the judging result. If the judging result indicates that the display module is supplied with power, the output control module 3 will retrieve from the storage module 2 the preset image stored therein and transmit the retrieved preset image to the display screen 100.

Further, referring to FIG. 2, the output control module 3 can comprise an enable unit 31 connected with the judgment module 1 and a retrieving unit 32 connected with the enable unit 31. The retrieving unit 32 is further connected with the storage module 2. The retrieving unit 32 is also connected with the display screen 100. When receiving a judging result that the display module is supplied with power sent from the judgment module 1, the enable unit 31 generates an enable signal V2 and sends the enable signal V2 to the retrieving unit 32. The retrieving unit 32 receives the enable signal V2, retrieves the preset image stored in the storage module 2 under the control of the enable signal V2, and transmits the retrieved preset image to the display screen 100.

In the above scheme in which the output control module 3 comprises the enable unit 31 and the retrieving unit 32, the enable unit 31 can comprise a first switching transistor T1 and a second switching transistor T2, one of which is a switching transistor switched on under high level and the other of which is a switching transistor switched on under low level. The first switching transistor has a control terminal which is connected with the judgment module 1, an input terminal which is connected with a power supply voltage and can receive the power supply voltage Vdd, and an output terminal which is connected with the retrieving unit 32. The second switching transistor T2 has a control terminal which is connected with the judgment module 1, an input terminal which is grounded, and an output terminal is connected with the retrieving unit 32.

An operating process of the control device as illustrated in FIG. 2 is described by taking an example that the first switching transistor T1 is switched on under high level while the second switching transistor T2 is switched on under low level. The first input terminal of the amplifier A receives the reference voltage Vref, while the second input terminal of the amplifier A receives the supply voltage Vin. The amplifier A compares the supply voltage Vin with the reference voltage Vref.

When the display module is supplied with power, the supply voltage Vin is at high level and Vin is greater than or equal to Vref, the amplifier A thus outputs a control signal V1 in which V1 is greater than 0V. The control signal V1 turns on the first switching transistor T1. The input terminal of the first switching transistor T1 receives the power supply voltage signal Vdd, so that the output terminal of the first switching transistor T1 outputs a high level signal which is referred to the enable signal V2. At the same time, the control signal V1 turns off the second switching transistor T2 and there is no output from the output terminal thereof. The enable signal V2 is transmitted to the retrieving unit 32. Under the control of the enable signal V2, the retrieving unit 32 retrieves the preset image from the storage module 2 and sends the preset image to the display screen 100. After receiving the preset image, the display screen 100 displays the preset image. Since the preset image which is stored in advance is retrieved directly from the storage module 2 without any transmission by use of the control chip, the process of retrieving and displaying the preset image is very fast. That is to say, the preset image can be displayed immediately after the display module is supplied with power.

When the display module is not supplied with power, the supply voltage Vin is low and Vin is less than Vref, the amplifier A thus outputs a control signal V1 in which V1 is less than 0V. The control signal V1 turns off the first switching transistor T1 and there is no output from the output terminal of the first switching transistor T1. At the same time, the control signal V1 turns on the second switching transistor T2. The input terminal of the second switching transistor T2 is grounded, so that the output terminal of the second switching transistor T2 outputs a low level signal. The low level signal cannot enable the retrieving unit 32. That is to say, the retrieving unit 32 cannot retrieve the preset image from the storage module 2 at this time and thus the display screen will not display the preset image.

It is to be noted that the above operating process is described by an exemplification in which the first switching transistor T1 is a switching transistor switched on under high level and the second switching transistor T2 is a switching transistor switched on under low level. An operating process in case that the first switching transistor T1 is a switching transistor switched on under low level and the second switching transistor T2 is a switching transistor switched on under high level is similar to the above-described operating process, and will not be elaborated herein.

By using the above control device according to the present embodiment, when the display module is supplied with power, the preset image is immediately displayed on the display screen 100. When the display module is not supplied with power, the display screen 100 does not display the preset image. Therefore, when the display module is supplied with power, initialization and lighting on the backlight source can be concurrently performed while ensuring a short booting time. Since the display screen 100 can display the preset image immediately after power-on, flickering screen and blurred screen caused by concurrently performing initialization and lighting on the backlight source can be eliminated.

Since flickering screen and blurred screen occur at the time when the initialized image information has not been transmitted to the display screen 100, at the time when the pixel electrode and the common electrode of the display screen 100 are not applied with a voltage and the display screen 100 is in an OFF state, in order to further address the problems of flickering screen and blurred screen, in one embodiment of the present disclosure, the color of the preset image is selected as the same as that displayed by the display screen 100 when the display screen 100 is in the OFF state. The term "OFF state" is as follows. As for a liquid crystal display screen, the voltage difference between its pixel electrode and its common electrode is zero, and the liquid crystalline molecules is not deflected, and is maintained in the initial orientation state.

It can be seen from the above that the color displayed by the display screen 100 when it is in the OFF state is correlated with the initial orientation state of the liquid crystalline molecules of the display screen 100. For example, if the initial orientation of the liquid crystalline molecules causes light to twist by 90° from an upper polarizer to a lower polarizer so that the display screen 100 becomes completely transmissive, the color displayed by the display screen 100 when it is in the OFF state is white. If the initial orientation of the liquid crystalline molecules causes no twist of light from an upper polarizer to a lower polarizer (i.e., the twist angle is 0) so that the display screen 100 becomes completely opaque, the color displayed by the display screen 100 when it is in the OFF state is black. That is to say, the color displayed by the display screen 100 when it is in the OFF state is black or white. Therefore, the preset image can be selected as a black image or a white image.

It can be determined according to the type of the display screen 100 whether a black image or a white image is selected as the preset image. If the display screen 100 is a display screen displaying in white when it is in the OFF state, a white image should be selected as the preset image. For example, as for TN (Twisted Nematic) type display screen, it displays in white when in the OFF state, and thus the preset image stored in the storage module 2 is selected to be a white image. If the display screen 100 is a display screen displaying in black when it is in the OFF state, a black image should be selected as the preset image. For example, as for IPS (In-Plane Switching) type display screen, it displays in black when in the OFF state, and thus the preset image stored in the storage module 2 shall be a black image.

In the control device according to the present disclosure, the storage module 2 can be a ROM (Read Only Memory). By using a ROM to store the preset image, data of the preset image is stable and will not be changed in case of power cutting, and retrieval of data of the preset image is convenient.

It is to be noted that the control device according to the present disclosure is applicable to display devices which have problems of flickering screen or blurred screen caused by concurrently performing initialization and lighting on backlight source at the time of booting, especially to liquid crystal display devices, such as liquid crystal display devices of ADS (Advanced Super Dimension Switch) type, IPS (In-Plane Switching) type, FFS (Fringe Field Switching) type, TN (Twisted Nematic) type, MVA (Multi-domain Vertical Alignment) type, PVA (Patterned Vertical Alignment) type and the like.

Figure 3:
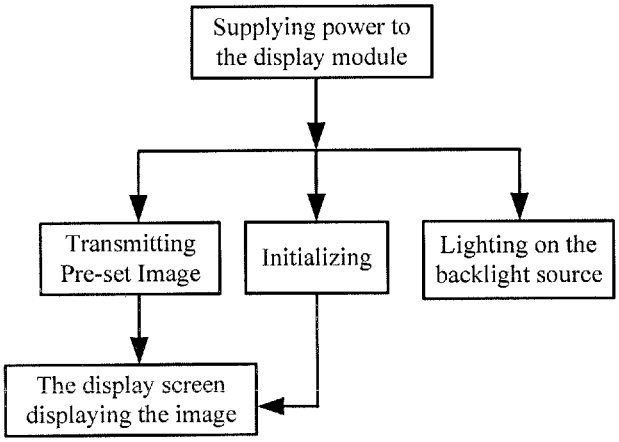
FIG. 3 is a flow chart of a control method according to Embodiment Two of the present disclosure.

At least one embodiment of the present disclosure provides a control method for a display module. As illustrated in FIG. 3, the control method comprises: supplying power to the display module; and then transmitting a preset image to the display screen of the display module, while initializing the display screen and lighting on the backlight source of the display module. That is to say, after the display module is supplied with power, three operations of transmitting the preset image, initialization and lighting on the backlight source are concurrently performed. The operation of transmitting the preset image can be achieved by the control device of the display module mentioned above.

By means of the above-described control method, after the display module is supplied with power, the preset image is immediately sent to the display screen and the display screen immediately displays the preset image. At this time, although the initialization has not been finished yet while the backlight source is lighted on, flickering screen and blurred screen will not occur because the display screen is displaying the preset image. Therefore, flickering screen and blurred screen are avoided while ensuring that the booting time will not be prolonged.

It is to be noted that after the display screen receives the preset image and displays the preset image for a period, the initialization is finished and the image information transmitted during the initialization reaches the display screen and thus the display screen begins to display images normally.

The control method according to the present disclosure further comprises storing a preset image in advance, operation of which is accomplished by an external system. For example, before the display device leaves factory, the preset image can be burnt into the storage module of the display device by an external system (for example, a single chip microcomputer). Or alternatively, before the display device is used by a user, the preset image can be downloaded into the storage module of the display device by an external system (for example, a personal computer). It is to be noted that such operation of storing a preset image in advance can be a one-time operation. That is to say, by one storing operation, the preset image can be retrieved from the storage module and displayed every time the display device is powered on.

In one embodiment of the present disclosure, the color of the preset image is selected to be the same as that when the display screen is in the OFF state. If the color of the display screen is white when it is in the OFF state, the preset image can be a white image. If the color of the display screen is black when it is in the OFF state, the preset image can be a black image. Therefore, flickering screen and blurred screen can be further eliminated.

At least one embodiment of the present disclosure further provides a display device comprising a display module, a control chip and any one of the above control devices. The display module comprises a display screen and a backlight source laminated together. The control chip is connected with the display module. The display module is connected with the control device.

The control device of the display module included in the above-described display device can ensure a short booting time without flickering screen and blurred screen occurring when the display device is powered on, which optimizes the performance of the display device.

In the display device according to the embodiments of the present disclosure, for example, the control device can be integrated on the control chip so as to improve the integration of the internal structure of the display device.

It is to be noted that the display device provided by the embodiments of the present disclosure can be any product or component having a display function such as a liquid crystal panel, an electronic paper, a cell phone, a tablet PC, a television set, a display device, a laptop, a digital photo frame, a navigator and the like.

The foregoing are merely exemplary embodiments of the disclosure, but are not used to limit the protection scope of the disclosure. The protection scope of the disclosure shall be defined by the attached claims.

The present disclosure claims priority of Chinese Patent Application No. 201610028792.2 filed on Jan. 15, 2016, the disclosure of which is hereby entirely incorporated by reference as a part of the present disclosure.

The invention claimed is:

1. A control device, configured to control a display module and comprising a judgment circuit and a storage module, wherein the judgment circuit is configured to receive a reference voltage and to receive a supply voltage of the display module, and is configured to judge whether the display module is supplied with power or not according to the reference voltage and the supply voltage;

the storage module is connected with the judgment circuit and is connected with a display screen of the display module, the storage module is configured to store a preset image, and when the display module is supplied with power, the storage module transmits the preset image to the display screen so that the display screen displays the preset image;

the control device further comprises an output control circuit which is connected with the judgment circuit and is connected with the storage module and which is connected with the display screen; the output control circuit is configured to retrieve the preset image stored in the storage module and transmit the preset image to the display screen when the display module is supplied with power;

the output control circuit comprises an enable sub-circuit and a retrieving sub-circuit;

the enable sub-circuit is connected with the judgment circuit and the enable sub-circuit is configured to generate and output an enable signal when the display module is supplied with power; and the retrieving sub-circuit is connected with the enable sub-circuit and is connected with the storage module, and the retrieving sub-circuit is connected with the display screen, the retrieving sub-circuit is configured to retrieve the preset image stored in the storage module under the control of the enable signal and transmit the preset image to the display screen.

2. The control device according to claim 1, wherein the enable sub-circuit comprises a first switching transistor and a second switching transistor, one of which is a switching transistor switched on under high level and the other of which is a switching transistor switched on under low level, wherein the first switching transistor has a control terminal which is connected with the judgment circuit, an input terminal which is configured to receive the supply voltage, and an output terminal which is connected with the retrieving sub-circuit; and the second switching transistor has a control terminal which is connected with the judgment circuit, an input terminal which is grounded, and an output terminal is connected with the retrieving sub-circuit.

3. The control device according to claim 1, wherein the storage module is a ROM.

4. The control device according to claim 1, wherein the preset image has a color which is the same as that displayed when the display screen is in OFF state, and the preset image is a black image or a white image.

5. The control device according to claim 1, wherein the reference voltage is in a range of 0 to 2V.

6. A display device comprising a display module, wherein the display device further comprises the control device according to claim 1, and the control device is connected with the display module.

7. The display device according to claim 6, wherein the control device is integrated in a control chip.

8. The control device according to claim 1, wherein the judgment circuit comprises a comparator which is configured to compare the reference voltage with the supply voltage and to generate a comparing result.

9. The control device according to claim 8, wherein the comparator comprises a first input terminal which is configured to receive the reference voltage, a second input terminal which is configured to receive the supply voltage and an output terminal which is connected with the storage module.

10. The control device according to claim 9, wherein the judgment circuit further comprises a first resistor, a second resistor, a third resistor and a fourth resistor, wherein a first end of the first resistor is configured to receive the reference voltage and a second end of the first resistor is connected with the first input terminal of the comparator;

a first end of the second resistor is connected with the first input terminal of the comparator and a second end of the second resistor is grounded;

a first end of the third resistor is configured to receive the supply voltage and a second end of the third resistor is connected with the second input terminal of the comparator; and a first end of the fourth resistor is connected with the second input terminal of the comparator and a second end of the fourth resistor is connected with the output terminal of the comparator.

* * * * *